US012532966B2

(12) United States Patent
Murphy

(10) Patent No.: US 12,532,966 B2
(45) **Date of Patent: *Jan. 27, 2026**

(54) RECIPROCATING-RECLINING SEATING UNIT WITH POWER ACTUATORS

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 215 days.

This patent is subject to a terminal disclaimer.

(21) Appl. No.: 18/476,062

(22) Filed: Sep. 27, 2023

(65) Prior Publication Data

US 2024/0138569 A1 May 2, 2024

Related U.S. Application Data

(60) Provisional application No. 63/500,733, filed on May 8, 2023, provisional application No. 63/381,606, filed on Oct. 31, 2022.

(51) Int. Cl.
*A47C 1/024* (2006.01)
*A47C 1/035* (2006.01)
(Continued)

(52) U.S. Cl.
CPC ..... *A47C 1/0355* (2013.01); *A47C 1/0242* (2013.01); *A47C 3/0255* (2013.01); *A47C 1/035* (2013.01)

(58) Field of Classification Search
CPC ..... A47C 1/0242; A47C 1/035; A47C 1/0355
See application file for complete search history.

(56) References Cited

U.S. PATENT DOCUMENTS 4,915,444 A 4/1990 Rogers, Jr.
6,540,291 B2 4/2003 Hoffman et al.
(Continued)

FOREIGN PATENT DOCUMENTS

CN 104622084 A 5/2015
EP 3143902 A1 * 3/2017 ..... A47C 1/035

OTHER PUBLICATIONS

International Search Report and Written Opinion corresponding to PCT/US2023/075299; mailed Jan. 24, 2024, (11 pages).
(Continued)

*Primary Examiner* — Rodney B White
(74) *Attorney, Agent, or Firm* — Myers Bigel, P.A.

(57) ABSTRACT

A reclining seating unit includes: a base; a seat having a seat frame; a rocking unit configured to allow the seat to reciprocate relative to the base; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat and the footrest unit, the footrest mechanism configured to control relative movement of the footrest unit and the seat between retracted and extended positions, the footrest mechanism being decoupled from the reclining mechanism; a first linear actuator attached to the reclining mechanism and to the seat configured to move the seat and backrest between the upright and reclined positions; and a second linear actuator attached to the footrest mechanism and to the seat frame configured to move the footrest unit between the retracted and extended positions.

19 Claims, 19 Drawing Sheets

(51) Int. Cl.
*A47C 1/0355* (2013.01)
*A47C 3/025* (2006.01)

(56) References Cited

U.S. PATENT DOCUMENTS

| | | | | |
|---|---|---|---|---|
| 7,731,276 | B2 | 6/2010 | Hoffman et al. | |
| 7,766,421 | B2 * | 8/2010 | Lawson | A47C 1/0355 297/85 M |
| 8,123,288 | B2 | 2/2012 | Murphy et al. | |
| 8,297,693 | B2 | 10/2012 | Hoffman et al. | |
| 8,459,733 | B2 | 6/2013 | Hoffman et al. | |
| 8,608,240 | B2 * | 12/2013 | Marshall | A47C 7/5068 297/89 |
| 8,727,433 | B2 * | 5/2014 | Lawson | A47C 1/0355 297/85 M X |
| 9,332,844 | B2 * | 5/2016 | Regev | A47C 3/025 |
| 9,357,847 | B2 * | 6/2016 | Murphy | A47C 1/0345 |
| 9,743,770 | B1 * | 8/2017 | Pollard | A47C 1/0355 |
| 10,334,951 | B2 * | 7/2019 | Robertson | A47C 1/0355 |
| 10,492,613 | B2 * | 12/2019 | LaPointe | A47C 7/563 |
| 10,561,244 | B2 * | 2/2020 | Lapointe | A47C 1/0355 |
| 11,583,084 | B2 * | 2/2023 | Loccioni | A47C 3/0251 |
| 11,737,561 | B2 * | 8/2023 | Schuster | A47C 1/0355 297/423.19 |
| 2008/0150329 | A1 * | 6/2008 | Lawson | A47C 1/0355 297/84 |
| 2010/0127538 | A1 | 5/2010 | Hoffman et al. | |
| 2013/0175846 | A1 | 7/2013 | Lawson | |
| 2016/0100686 | A1 | 4/2016 | Regev | |
| 2016/0100687 | A1 | 4/2016 | Murphy et al. | |
| 2017/0347797 | A1 * | 12/2017 | Robertson | A47C 1/0242 |
| 2022/0015543 | A1 | 1/2022 | Bryant | |
| 2022/0400863 | A1 * | 12/2022 | Murphy | A47C 1/0242 |
| 2024/0122346 | A1 * | 4/2024 | Murphy | A47C 1/0355 |

OTHER PUBLICATIONS

"International Preliminary Report on Patentability corresponding to International Application No. PCT/US2023/075299 mailed May 15, 2025".

* cited by examiner

RECIPROCATING-RECLINING SEATING UNIT WITH POWER ACTUATORS

RELATED APPLICATION

This application claims priority from and the benefit of U.S. Provisional Patent Application Nos. 63/381,606, filed Oct. 31, 2022 and 63/500,733, filed May 8, 2023, the disclosures of which are hereby incorporated by reference herein in full.

FIELD OF THE INVENTION

The present invention relates generally to seating units, and relates more particularly to reclining seating units.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr. and U.S. Pat. No. 6,540,291 to Hoffman, which illustrate chairs of rather contemporary style with three-way reclining capability. Other reclining chairs may have decoupled reclining and footrest-extending mechanisms. See, e.g., U.S. Pat. No. 7,731,276 to Hoffman et al.

In recent years, furniture designers have looked for alternatives to rocking chairs that can provide a similarly relaxing repetitive motion. One alternative has been the rocking-reclining chair, or "rocker", which includes structure that enables the seat portion of the chair to "rock" forwardly and rearwardly relative to its base to mimic generally the rocking motion of a traditional rocking chair. Exemplary rocker-recliners are discussed in, for example, U.S. Pat. No. 8,459,733 to Hoffman and U.S. Pat. No. 8,123,288 to Murphy, the disclosures of which are hereby incorporated herein by reference in full.

Some reclining units have employed power actuators to recline the backrest and extend the footrest. See, e.g., U.S. Pat. No. 8,297,693 to Hoffman et al. It may be desirable to provide additional reclining units with power actuation, particularly in a rocker-recliner.

SUMMARY

As a first aspect, embodiments of the invention are directed to a reclining seating unit comprising: a base; a seat having a seat frame; a rocking unit configured to allow the seat to reciprocate relative to the base; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat and the footrest unit, the footrest mechanism configured to control relative movement of the footrest unit and the seat between retracted and extended positions, the footrest mechanism being decoupled from the reclining mechanism; a first linear actuator attached to the reclining mechanism and to the seat configured to move the seat and backrest between the upright and reclined positions; and a second linear actuator attached to the footrest mechanism and to the seat frame configured to move the footrest unit between the retracted and extended positions.

As a second aspect, embodiments of the invention are directed to a reclining seating unit comprising: a base; a seat having a seat frame; a reciprocating unit configured to allow the seat to move reciprocally relative to the base; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat and the footrest unit, the footrest mechanism configured to control relative movement of the footrest unit and the seat between retracted and extended positions, the footrest mechanism being decoupled from the reclining mechanism; a first linear actuator attached to the reclining mechanism and to the seat configured to move the seat and backrest between the upright and reclined positions; and a second linear actuator attached to the footrest mechanism and to the seat frame configured to move the footrest unit between the retracted and extended positions.

DETAILED DESCRIPTION OF EMBODIMENTS OF THE INVENTION

Figure 1:
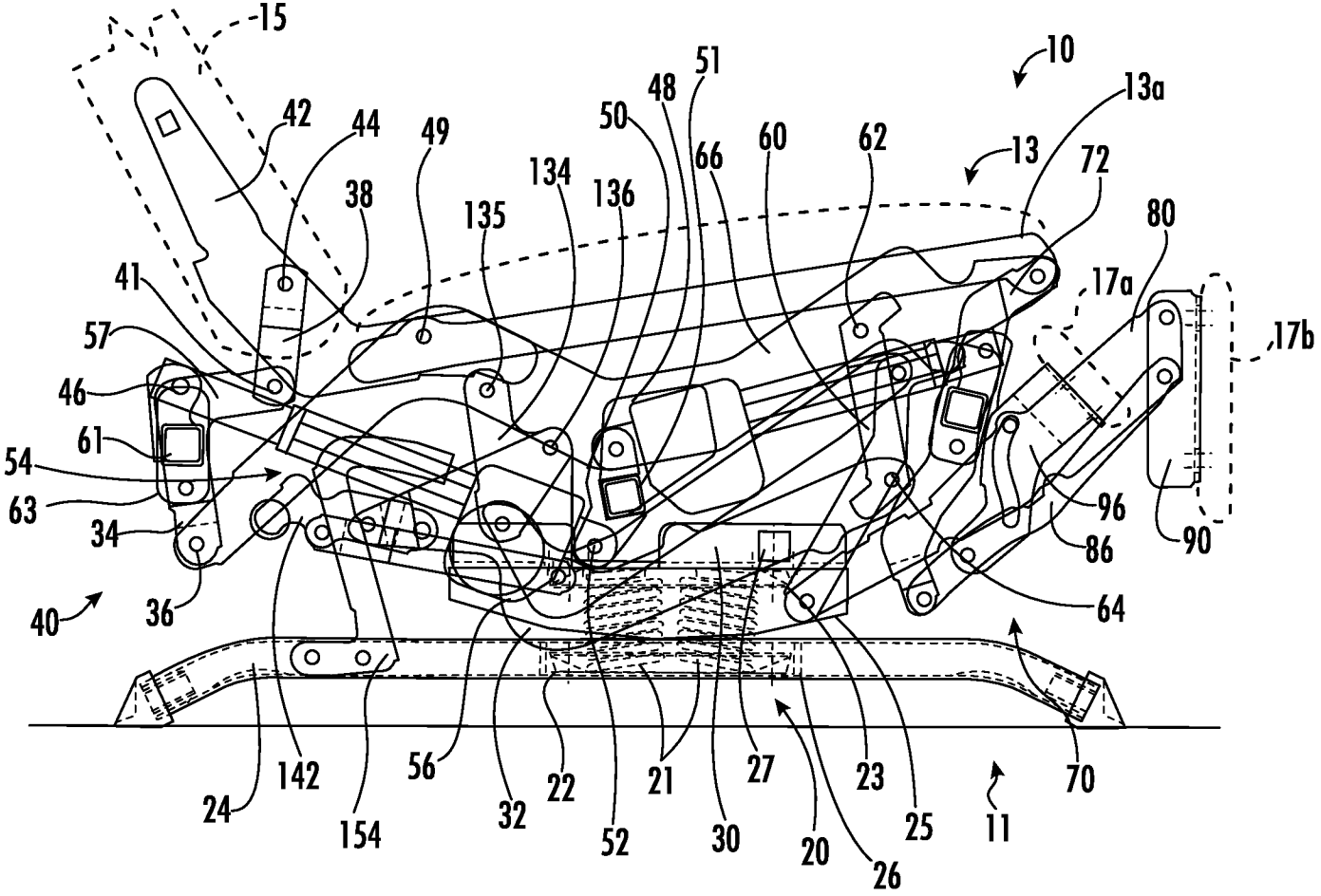
FIG. 1 is a side view of a rocker-recliner seating unit according to embodiments of the invention, with the backrest shown in an upright position and the footrests shown in a retracted position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to FIGS. 1-4, another embodiment of a rocker-recliner, designated broadly at 10, is illustrated therein. The chair 10 includes a base unit 11, a seat 13 that is generally horizontally disposed above the base unit 11 and includes an underlying open seat frame 13*a*, a backrest 15 that is generally vertically and disposed substantially above a rear portion of the seat 13, an arm frame (not shown), and two footrests 17*a*, 17*b*, which, in the upright position of FIG. 1, are generally vertically disposed below a front portion of the seat 13. Arms (not shown) are positioned on either side of the seat 13 and move in concert with the seat 13. The backrest 15 is mounted to the seating unit 10 via a reclining mechanism 40, and the footrests 17*a*, 17*b* are mounted to the seat via a footrest mechanism 70. These mechanisms 40, 70 are described in greater detail below.

The base unit 11 includes a rocking assembly 20. The rocking assembly 20 includes vertically-oriented springs 21 that are mounted between plates 22, 23. The lower plate 22 is mounted to cross-members 26, which are in turn mounted to a longitudinally-extending leg member 24. The upper plate 23 is mounted to a rocker cam 25 that has an arcuate lower surface that bears against the upper surface of the leg member 24. This configuration enables the upper plate 23 to rock relative to the lower plate 22, with the movement defined by the lower surface of the rocker cam 25, and with the movement resisted (and therefore controlled) by the springs 21.

A mounting bracket 30 is fixed to the upper plate. A cross-member 27 spans the mounting brackets 30 on opposite sides of the seating unit 10 to ensure that the rocking motion is synchronized on both sides of the seating unit 10. The mounting bracket 30 is fixed to a second mounting bracket 32.

A seat adapter 66 is fixed to the seat frame 13*a* to provide additional locations for the mounting of additional mechanism links. A swing link 60 with tabs on either end is mounted to the front portion of the seat adapter 66 at a pivot 62 and to a front portion of the mounting bracket 32 at a pivot 64. Also, a V-shaped swing link 134 is attached at the upper end of its rearward leg to the seat adapter 66 at a pivot 135, and at the upper end of its forward leg to the mounting bracket 32 at a pivot 136.

As noted above, the chair 10 includes the reclining mechanism 40, which reclines the backrest 15 (shown in FIGS. 2 and 4) relative to the seat 13. The reclining mechanism 40 includes an L-shaped drive link 34 that is attached to the rear end of the seat adapter 66 at a pivot 36. At its opposite end, the drive link 34 is attached to the lower end of a control link 38 at a pivot 41. A backpost 42 is fixed to the backrest 15. The front end of the backpost 42 is attached to the seat adapter 66 at a pivot 49. The upper end of the control link 38 is attached to the backpost 42 at a pivot 44.

A linear actuator 54 controls the movement of the reclining mechanism 40. The linear actuator 54 includes a motor 56 and a retractable rod 57. The rod 57 is attached in alignment with the vertex of the drive link 34 at a pivot 46 via a cross-member 61 and a bracket 63. At the opposite end of the linear actuator 54, the motor 56 is mounted to the seat adapter 66 via a mounting plate 48 fixed to the seat adapter 66, a cross-member 51 that spans the mounting plates 48 on either side of the chair 10, and a dual tab 50 fixed to the cross-member 51; the motor 56 is mounted to the lower end of the dual tab 50 at a pivot 52.

Figure 3:
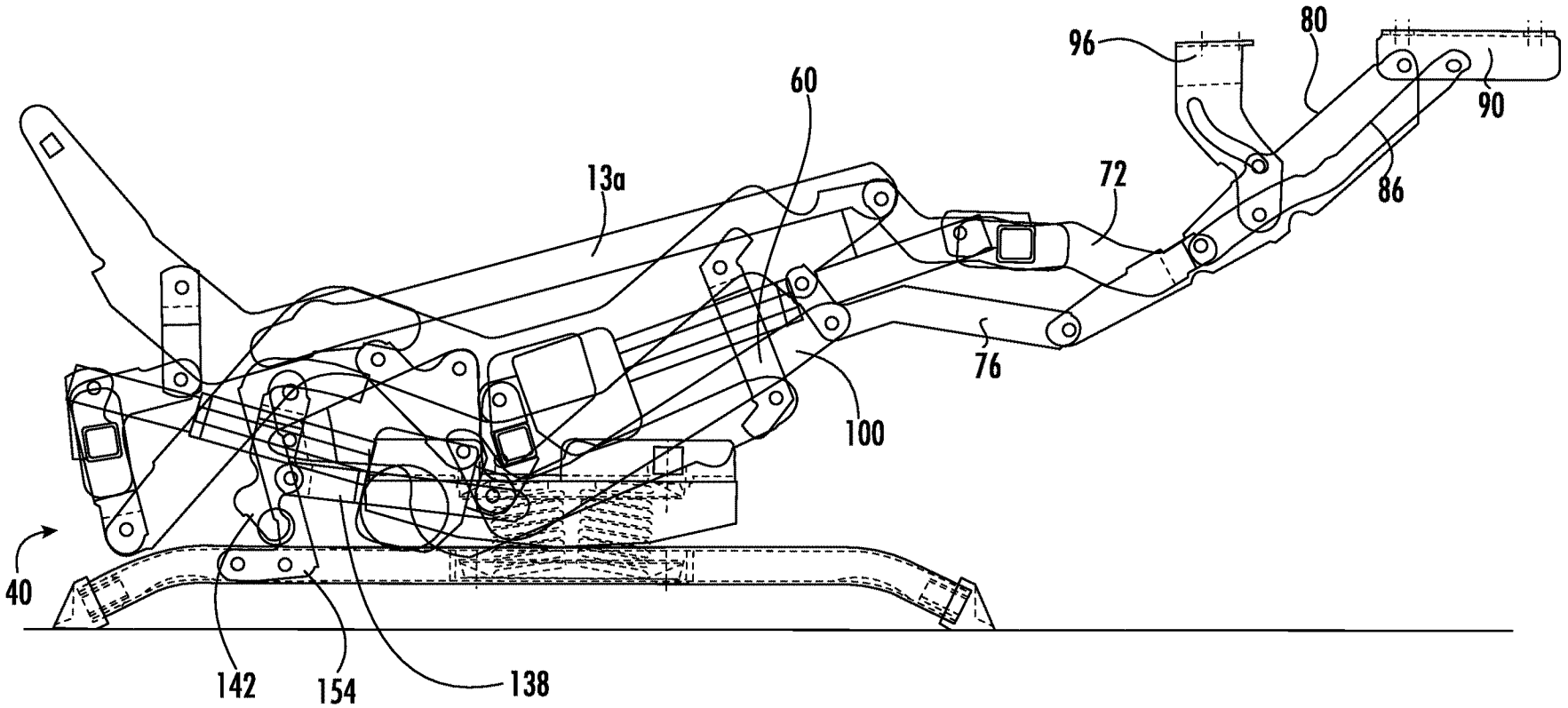
FIG. 3 is a side view of the seating unit of FIG. 1, with the backrest shown in an upright position and the footrests shown in an extended position.

The backrest 15 is shown in FIGS. 1 and 3 in its upright position. To move the backrest 15 to its reclined position, an occupant of the chair 10 actuates the motor 56 of the linear actuator 54, which causes the rod 57 to retract. Retraction of the rod 57 rotates the drive link 34 clockwise about the pivot 36, which forces the control link 38 forwardly and downwardly and causes it to rotate counterclockwise about the pivot 44. Movement of the control link 38 draws the backpost 42 (and in turn the backrest 15) counterclockwise about the pivot 49 with the seat adapter 66. Thus, the backrest 15 reclines relative to the seat 13.

Figure 2:
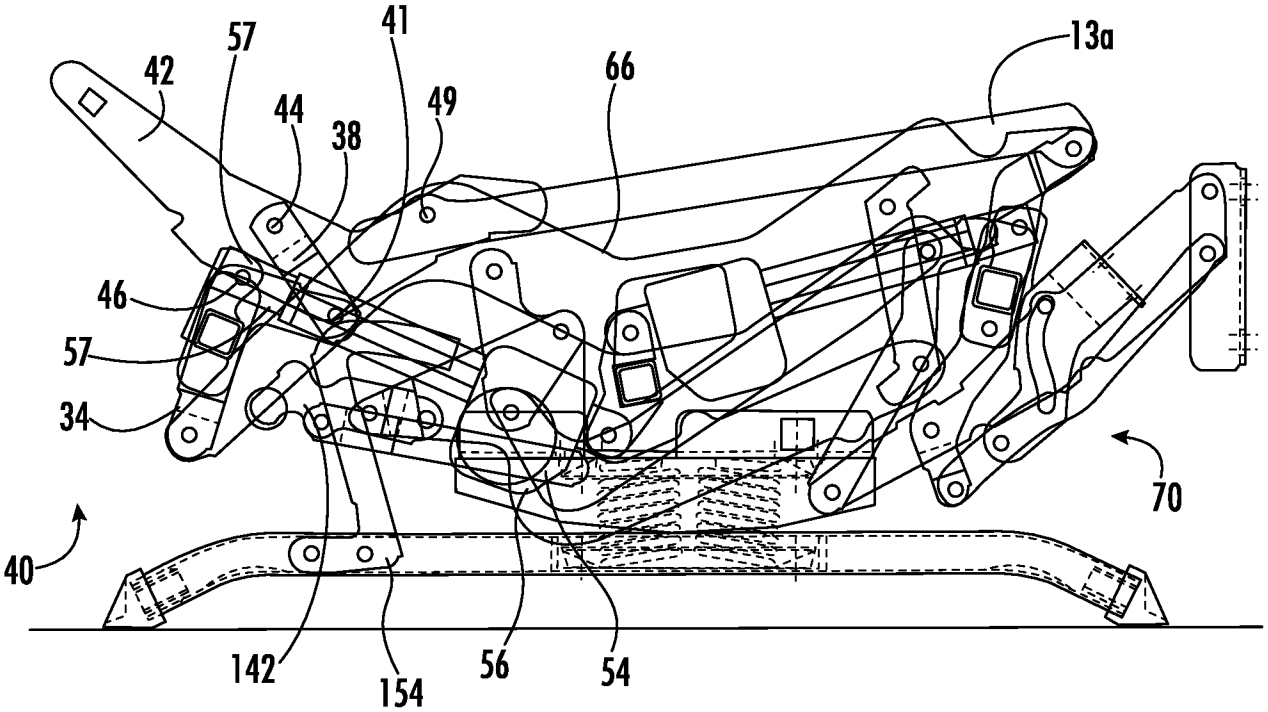
FIG. 2 is a side view of the seating unit of FIG. 1, with the backrest shown in a reclined position and the footrests shown in a retracted position.
Figure 4:
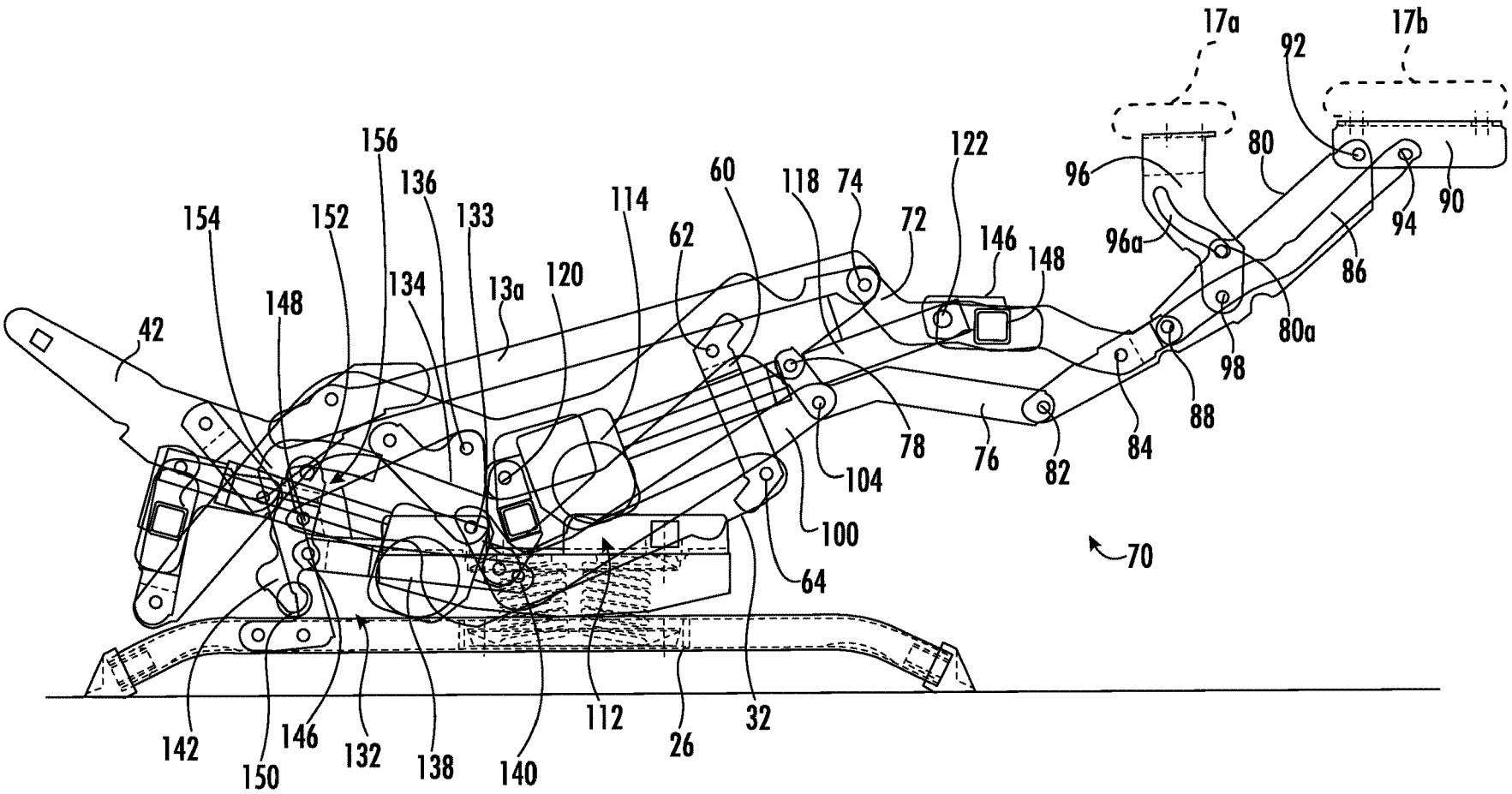
FIG. 4 is a side view of the seating unit of FIG. 1, with the backrest shown in a reclined position and the footrests shown in an extended position.

It will be understood that the backrest 15 can recline relative to the seat 13 whether the footrests 17*a*, 17*b* are retracted as in FIGS. 1 and 2 or extended as in FIGS. 3 and 4. Also, the seat 13 and backrest 15 are free to rock relative to the base 11 in either the upright position or the reclined position as long as the footrests 17*a*, 17*b* are retracted as shown in FIGS. 1 and 2.

Referring now to FIG. 4, the footrest mechanisms 70 interconnect the footrests 17*a*, 17*b* with the seat frame 13*a* (FIG. 4 shows the footrests 17*a*, 17*b* in their extended position for clarity of description). An upper ottoman swing link 72 is attached to a front region of the seat adapter 66 at a pivot 74 and extends downwardly and forwardly therefrom. A tripartite lower ottoman swing link 76 is attached to a pivot 78 that is located rearwardly and downwardly from the pivot 74; the lower ottoman swing link 76 extends generally forwardly from the pivot 78. An upper ottoman extension link 80 is attached to the forward end of the lower ottoman swing link 76 at a pivot 82 and extends forwardly and upwardly therefrom. Also the upper ottoman extension link 80 is attached to the upper ottoman swing link at a pivot 84. A lower ottoman extension link 86 is attached to the forward end of the upper ottoman swing link at a pivot 88 that is positioned above and forward of the pivot 84 and extends upwardly and forwardly therefrom generally parallel with the upper ottoman extension link. An outer ottoman bracket 90 is generally horizontally disposed and is attached to the upper and lower ottoman extension links 80, 86 at pivots 92, 94 respectively. The ottoman 17*b* is mounted on the outer ottoman bracket 90.

A bi-angled inner ottoman bracket 96 is attached at its lower, forward end to the lower ottoman extension link 86 at a pivot 98. At its opposite end, the inner ottoman bracket 96 supports the ottoman 17*a*. The inner ottoman bracket 96 also includes a slot 96*a* that receives a pin 80*a* located on the upper ottoman extension link 80.

Referring still to FIG. 4, the chair 10 includes a linear actuator 112 that drives the footrests 17*a*, 17*b* between their retracted and extended positions. The actuator 112 includes a motor 114 and a retractable rod 118. The motor 114 is attached to the upper end of the dual tab 50 at a pivot 120. The rod 118 of the actuator 112 is attached at a pivot 122 to a projecting bracket 146 that extends from a cross-member 148 between the upper ottoman swing links 72.

An angled connecting link 100 is attached at a pivot 104 with the lower ottoman swing link 76 and extends rearwardly and slightly downwardly therefrom. The connecting link 100 is pivotally connected to a locking mechanism 132 that can prevent the seat 13 and backrest 15 from rocking relative to the base 11 when the footrests 17*a*, 17*b* are extended. The locking mechanism 132 includes the V-shaped swing link 134, which is attached at its vertex to the rear end of the connecting link 100 at a pivot 133. At the end of its forward leg, the V-shaped swing link 134 is attached to the bracket 32 at the pivot 136. A drive link 138 is attached at its front end at a pivot 140 to the vertex of the connecting link 100 and extends rearwardly therefrom. A locking link 142 is attached at a pivot 146 to the rear end of the drive link 138. The locking link 142 is also attached to the rear end of the mounting bracket 32 at a pivot 148. The locking link 142 has a wheel 150 at its lower end and a post 152 at its upper end. A Z-shaped stop link 154 is fixed to the leg member 24; the upper legs of the stop link 154 form a forwardly-facing pocket 156.

As can be seen in FIG. 1, in the retracted position, the rod 118 of the actuator 112 is retracted. Because the rod 118 is in its retracted position, a pantographic linkage formed by the upper and lower ottoman swing links 72, 76 and the upper and lower ottoman extension links 80, 86 is folded under the seat frame 13*a*, which positions the footrest 17*a* underneath a forward portion of the seat frame 13*a* and the footrest 17*b* just forward of and below the seat frame 13*a* in a vertical orientation. Also, the locking link 142 is rotated about the pivot 148 to a generally horizontal position, with the wheel 150 at the rear end of the locking link 142 and the post 152 at the front end of the locking link 142. In this orientation, the locking link 142 does not interact with the stop link 154 or with the leg member 24. As such, the seat 13 and backrest 15 are free to rock relative to the base 11.

To move the footrests 17*a*, 17*b* from their retracted positions in FIG. 1 to their extended positions of FIGS. 3 and 4, an occupant of the chair 10 actuates the actuator 112, which causes the rod 118 to begin to extend away from the motor unit 114, thereby driving the lower ottoman swing link 76 counterclockwise about the pivot 78. Rotation of the lower ottoman swing link 76 forces the upper ottoman extension link 80 forward, which in turn draws the upper ottoman swing link 72 counterclockwise around the pivot 74. Also, the lower ottoman extension link 86 moves forwardly more than the upper ottoman extension link 80, such that the outer ottoman bracket 90 and the inner ottoman bracket 96 rotate counterclockwise (rotation of the inner ottoman bracket 96 causes the pin 80*a* to move in the slot 96*a* toward the pivot 98). The rotation of the outer and inner ottoman brackets 90, 96 induces the footrests 17*a*, 17*b* to rotate from a vertical orientation to a horizontal orientation.

In addition, the rotation of the lower ottoman swing link 76 draws the connecting link 100 forward. Movement of the connecting link 100 rotates the swing link 134 counterclockwise about the pivot 136, which draws the seat adapter 66 (and in turn the seat 13) slightly downwardly to increase the pitch angle of the seat 13. The front of the seat 13 is supported by the swing link 60, which pivots slightly counterclockwise about the pivot 64.

Movement of the connecting link 100 of the swing link 134 also drives the drive link 138 forwardly. The forward movement of the drive link 138 rotates the locking link 142 counterclockwise about the pivot 148, with the result that the post 152 of the locking link 142 is received in the pocket 156 of the stop link 154, and the wheel 150 of the locking link 142 engages the upper surface of the leg member 24. The engagement of the locking link 142 with the stop link 154 prevents rocking movement of the seat 13 relative to the base 11.

One potential advantage to embodiments of the invention assists in manufacturing of the chair. During manufacture, the reclining mechanisms, footrest mechanisms, the linear actuators, the rocking assembly and the base can be formed as a single assembly. Once constructed, they can be dropped into an inverted chair frame as a single unit and quickly and easily mounted to the backrest and seat and arm frames with a few screws and/or bolts. As such, construction of the seating unit is simplified markedly over typical recliners.

Figure 5:
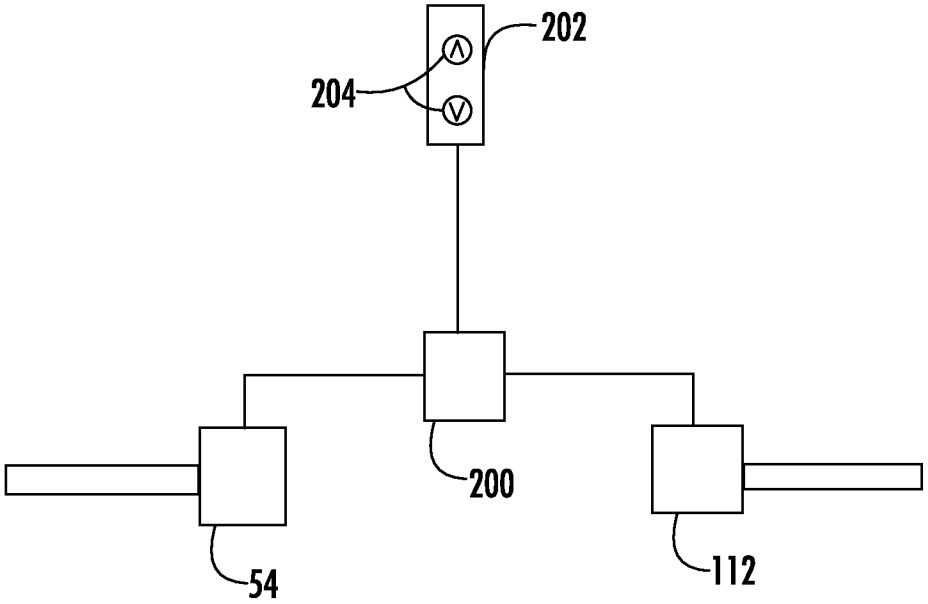
FIG. 5 is a schematic diagram showing the controller and actuating device operatively connected with the linear actuators of the seating unit of FIG. 1.

As shown schematically in FIG. 5, in some embodiments the linear actuator 112 and the linear actuator 54 may be operatively connected with a controller 200. The controller 200 can take many forms, including a printed circuit board (PCB) that includes components (such as microchips and the like) that control that operation of the linear actuators 54, 112. The controller 200 is operatively connected (i.e., hardwired or wirelessly) with an actuation device 202, which includes one or more manipulable features 204 such as a set of toggle switches or buttons, a joystick, or the like.

In some embodiments the controller 200 is configured so that the linear actuator 54, which drives the reclining motion of the backrest 15, cannot begin to recline the backrest 15 until the linear actuator 112, which controls the extension of the ottomans 17*a*, 17*b*, has reached a predetermined position. As one example, the controller 200 may be configured so that the linear actuator 54 cannot begin to recline the backrest 15 until the ottomans 17*a*, 17*b* are fully extended.

One advantage that can be realized by the inclusion of the controller 200 that can control the movement of both linear actuators 54, 112 is simplicity of operation. In a conventional three-way reclining chair, as described above, the chair moves from the upright position to the TV position, then from the TV position to the fully reclined position. In order for such movement to be mimicked in the rocker-recliner 10 discussed above, in which the reclining and footrest mechanisms are mechanically decoupled, the occupant of the rocker-recliner 10 must first actuate the linear actuator 112 to extend the ottomans 17*a*, 17*b*, then actuate the linear actuator 54 to recline the backrest 15. Typically, this requires the occupant to employ two different actuation devices (e.g., two sets of toggle buttons, or two joysticks) to complete both movements. The requirement of switching between actuation devices can be confusing, particularly for occupants who are unfamiliar with the rocker-recliner 10 or that are uncomfortable with such technology.

In contrast, the use of the controller 200 enables the use of a single actuation device 202 to complete the entire movement, even though two different linear actuators 54, 112 are included in the rocker-recliner 10. For example, the occupant may use a single manipulable feature 204 (e.g., a single button or toggle switch) to drive the rocker-recliner 10 from the upright position through the TV position and to the reclined position, and a different single manipulable feature 204 (e.g., a second toggle switch or button) to drive the rocker-recliner 10 to return to the upright position. As such, operation of the rocker-recliner 10 is much simpler and straightforward for the occupant.

Those of skill in this art will appreciate that the use of a controller operatively connected to both linear actuators and a single actuation device may be employed in other reclining chair styles. These include other rocker-recliners, glider-recliners, and non-reciprocating reclining seating units. The reclining seating units move be standalone chairs, sectional pieces, individual seats in a multi-seat piece (such as a love seat or sofa) or the like.

Figure 6:
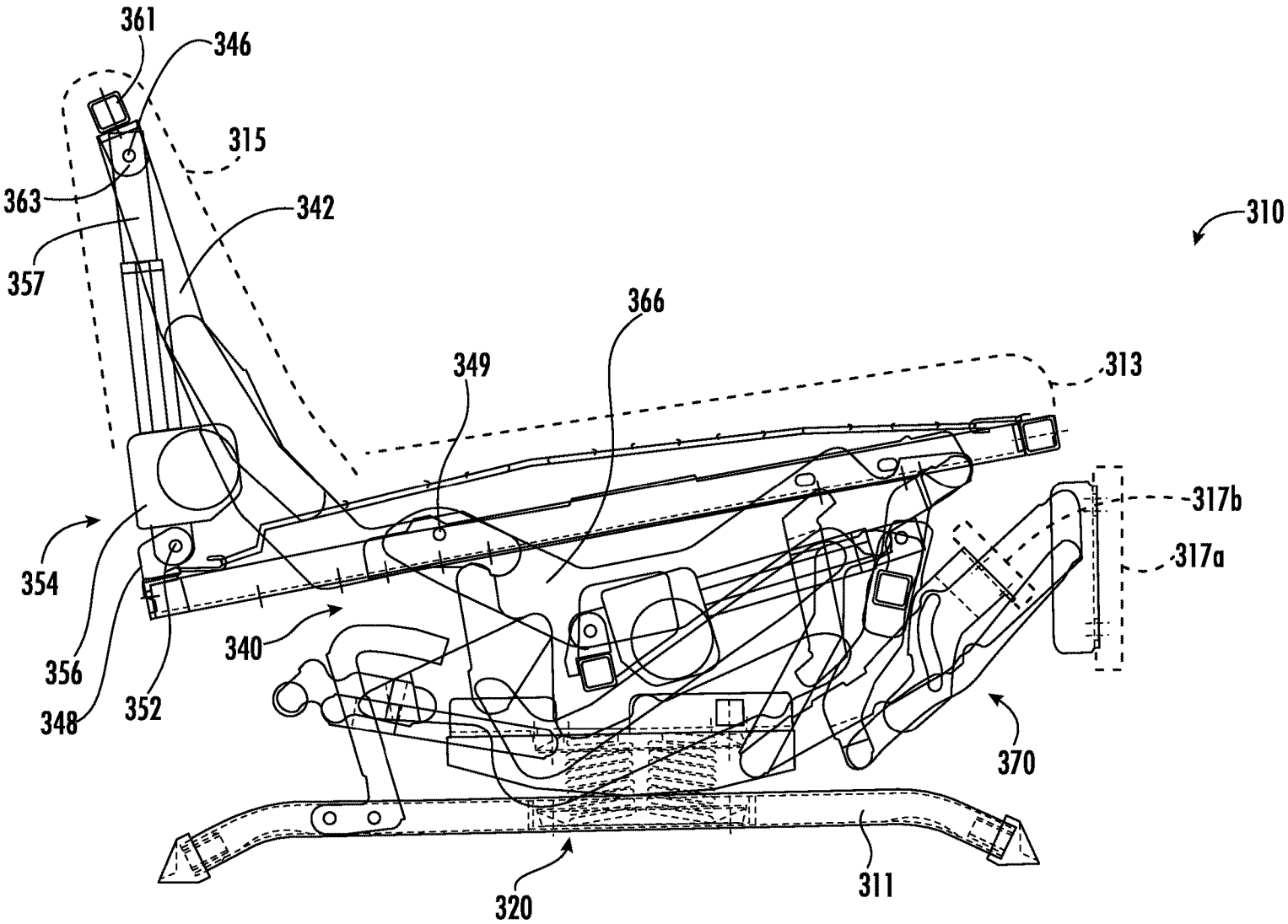
FIG. 6 is a side view of a rocker-recliner seating unit according to alternative embodiments of the invention, with the backrest shown in an upright position and the footrests shown in a retracted position.

Referring now to FIGS. 6-10, an alternative embodiment of a rocking-reclining seating unit, designated broadly at 310, is shown therein. The seating unit 310 is similar to the chair 10, having a base unit 311, a seat 313 that is generally horizontally disposed above the base unit 311, a backrest 315 that is generally vertically and disposed substantially above a rear portion of the seat 313, an arm frame (not shown), and two footrests 317*a*, 317*b*, which, in the upright position of FIG. 6, are generally vertically disposed below a front portion of the seat 313. Arms (not shown) are positioned on either side of the seat 313 and move in concert with the seat 313. The base unit 311 includes a rocking assembly 320 similar to the rocking unit 20 described above. The backrest 315 is mounted to the seating unit 310 via a reclining mechanism 340, and the footrests 317*a*, 317*b* are mounted to the seat via a footrest mechanism 370. While the footrest mechanism 370 is the same as the footrest mechanism 70 and need not be described again herein, the reclining mechanism 340 differs somewhat from the reclining mechanism 40 and is driven by a linear actuator 354 that is positioned differently within the seating unit 310. The reclining mechanism 340 is described in greater detail below.

Figure 7:
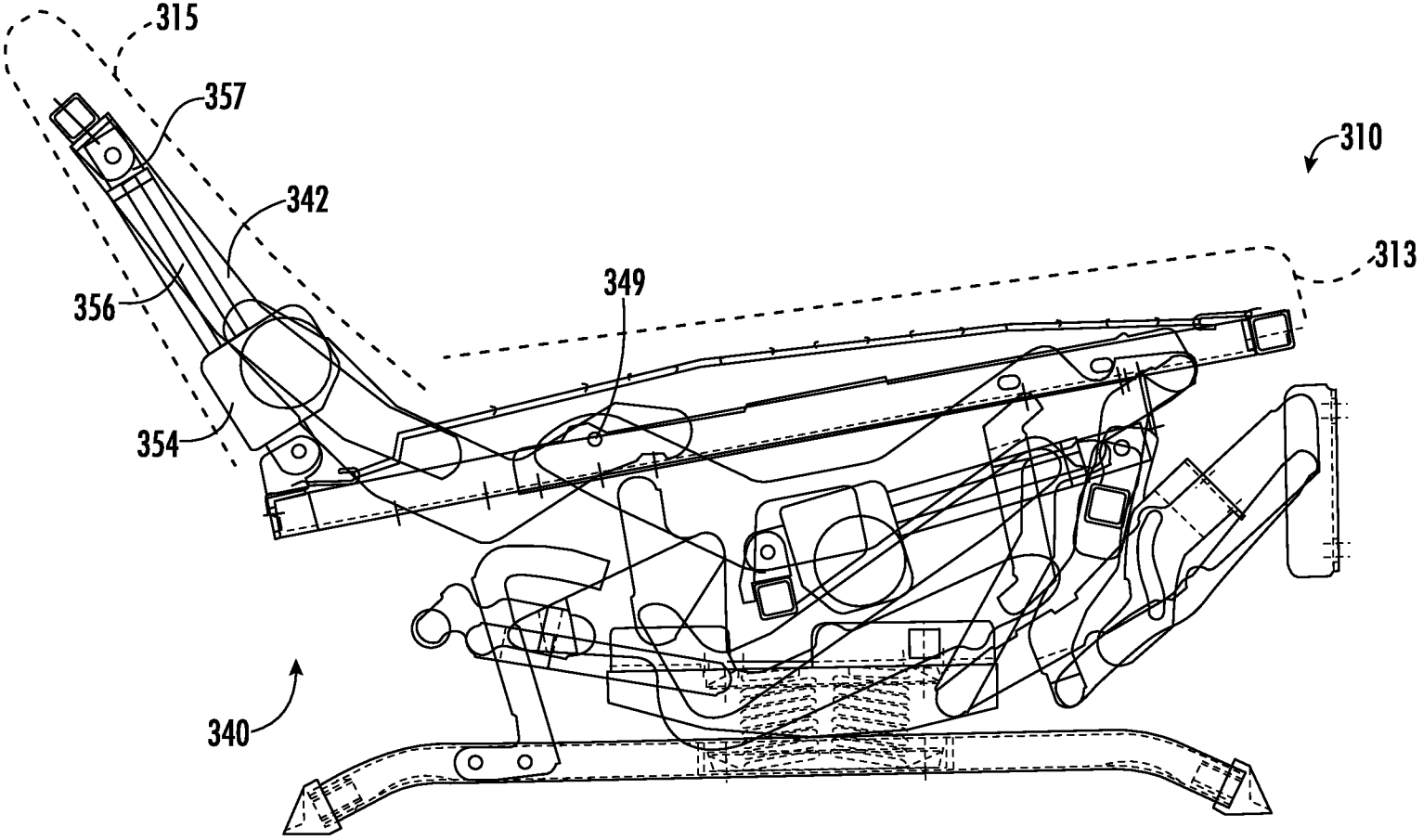
FIG. 7 is a side view of the seating unit of FIG. 6, with the backrest shown in a reclined position and the footrests shown in a retracted position.
Figure 8:
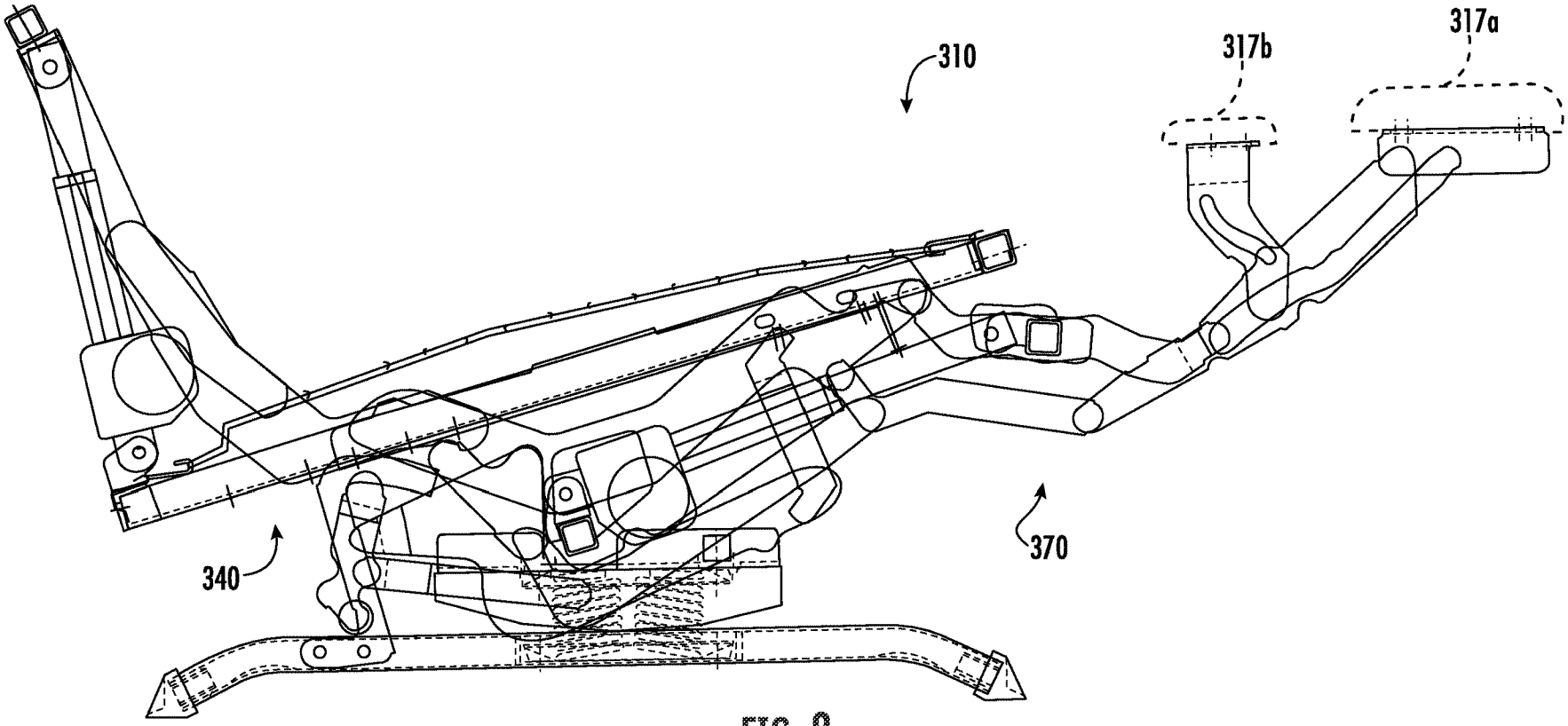
FIG. 8 is a side view of the seating unit of FIG. 6, with the backrest shown in an upright position and the footrests shown in an extended position.
Figure 9:
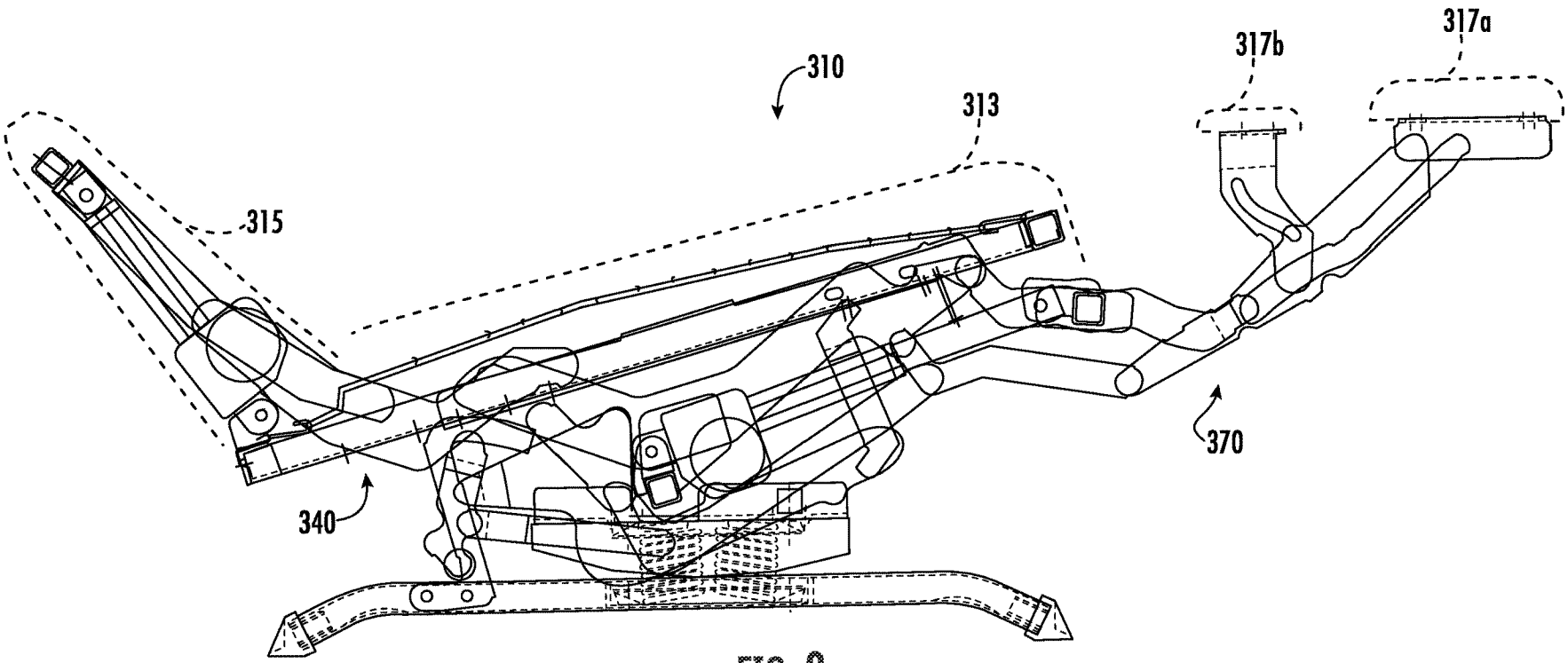
FIG. 9 is a side view of the seating unit of FIG. 6, with the backrest shown in a reclined position and the footrests shown in an extended position.
Figure 10:
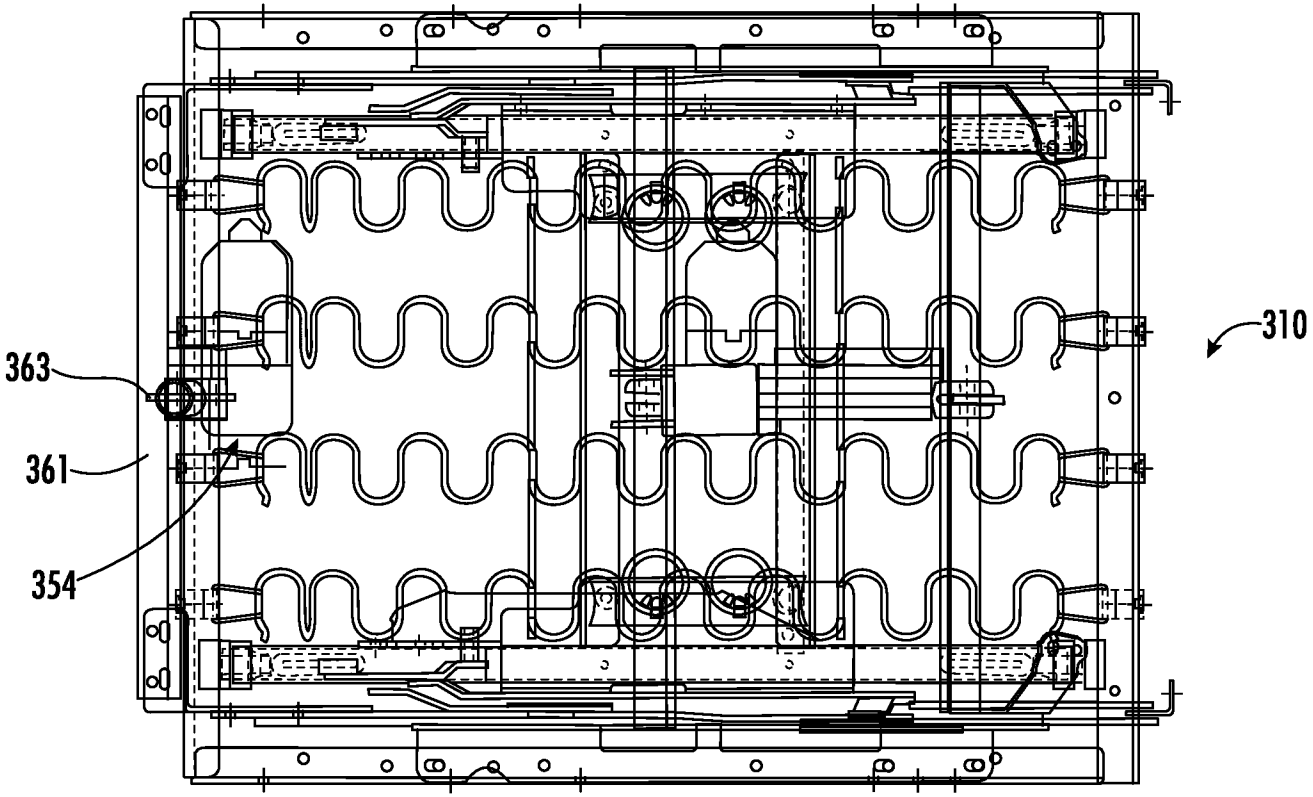
FIG. 10 is a top view of the seating unit of FIG. 6, with the backrest shown in an upright position and the footrests shown in a retracted position.

Referring now to FIGS. 7 and 9, the reclining mechanism 340 includes a backpost 342 (shown herein as two different links that are fixed relative to each other) that is fixed to the backrest 315. The front end of the backpost 342 is attached to the seat adapter 366 at a pivot 349. A linear actuator 354 includes a motor 356 and a retractable rod 357. The rod 357 is attached to a bracket 363 at a pivot 346. The bracket 346 is fixed a cross-member 361 that is fiexd to and spans the upper ends of the backpost 342. At the opposite end of the linear actuator 354, the motor 356 is mounted at a pivot 352 to a bracket 348 fixed to the frame of the seat 313.

The footrests 317*a*, 317*b* are extended (FIGS. 8 and 9) and retracted (FIGS. 6 and 7) by the footrest mechanism 370 in the same manner as described above for the footrest mechanism 70. To move the backrest 315 to its reclined position from its upright position, an occupant of the chair 310 actuates the motor 356 of the linear actuator 354, which causes the rod 357 to retract. Retraction of the rod 357 draw the upper end of the backpost 342 downwardly, which action causes the backpost 342 to rotate counterclockwise about the pivot 349. The backrest 315 moves with the backpost 342; thus, the backrest 315 reclines relative to the seat 313.

The manufacturing advantages of the chair 10 may also be present in the seating unit 310. Further, a controller such as the controller 200 may be employed with the seating unit 310 and provide a similar advantage.

Referring now to FIGS. 11-19, another seating unit, designated broadly at 510, is shown therein. The seating unit 510 is similar to the seating unit 310, in that it has reclining and footrest linkages 540, 570 that are identical to the reclining and footrest linkages 340, 370; however, the seating unit 510 has a gliding unit 600 rather than a rocking unit that imparts a reciprocating gliding motion to the seating unit 510. The interconnection of the gliding unit 600 with the remainder of the seating unit 510 is discussed below.

Figure 11:
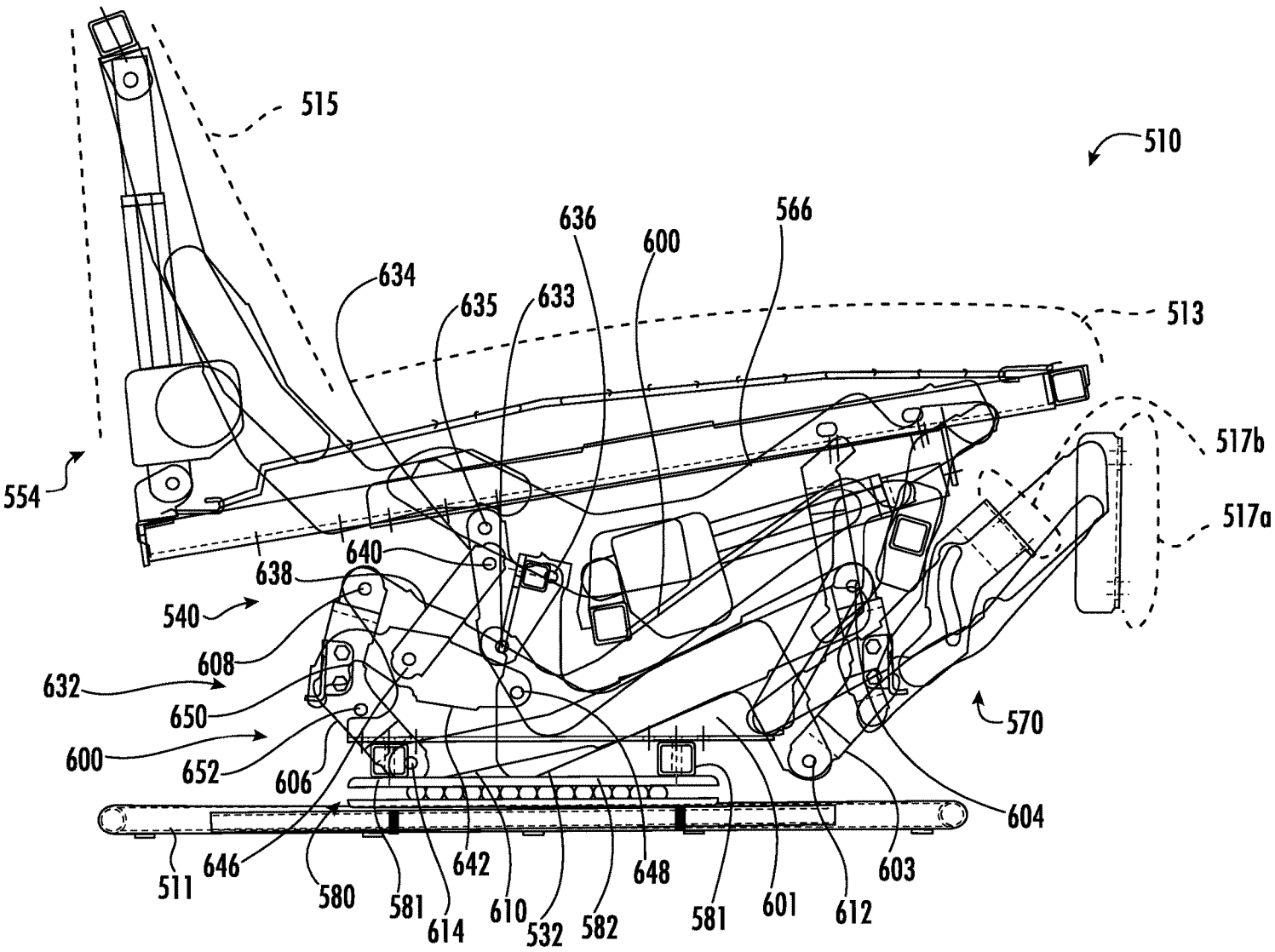
FIG. 11 is a side view of a glider-recliner seating unit according to further embodiments of the invention, with the backrest shown in an upright position and the footrests shown in a retracted position.
Figure 12:
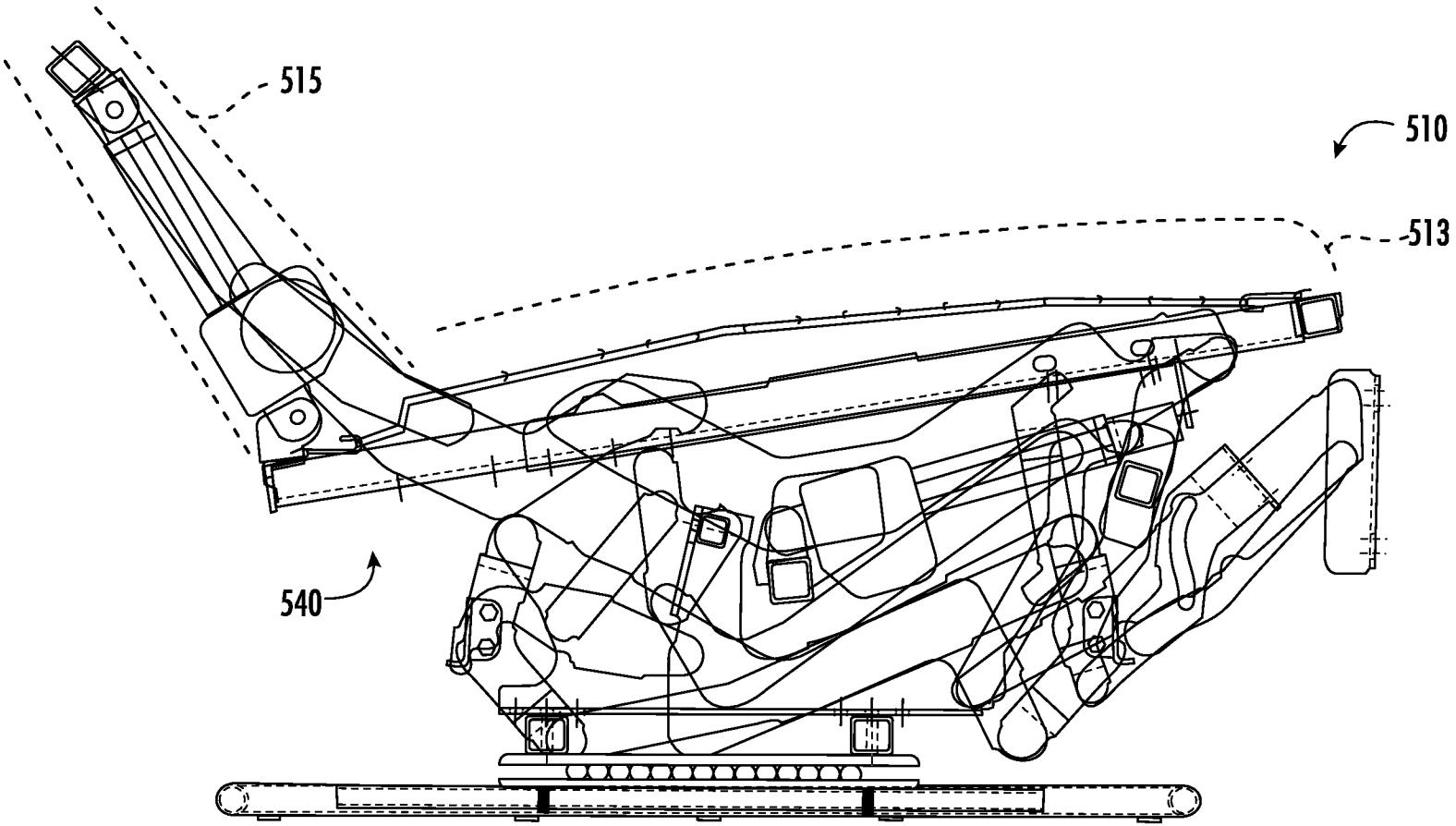
FIG. 12 is a side view of the seating unit of FIG. 11, with the backrest shown in a reclined position and the footrests shown in a retracted position.
Figure 13:
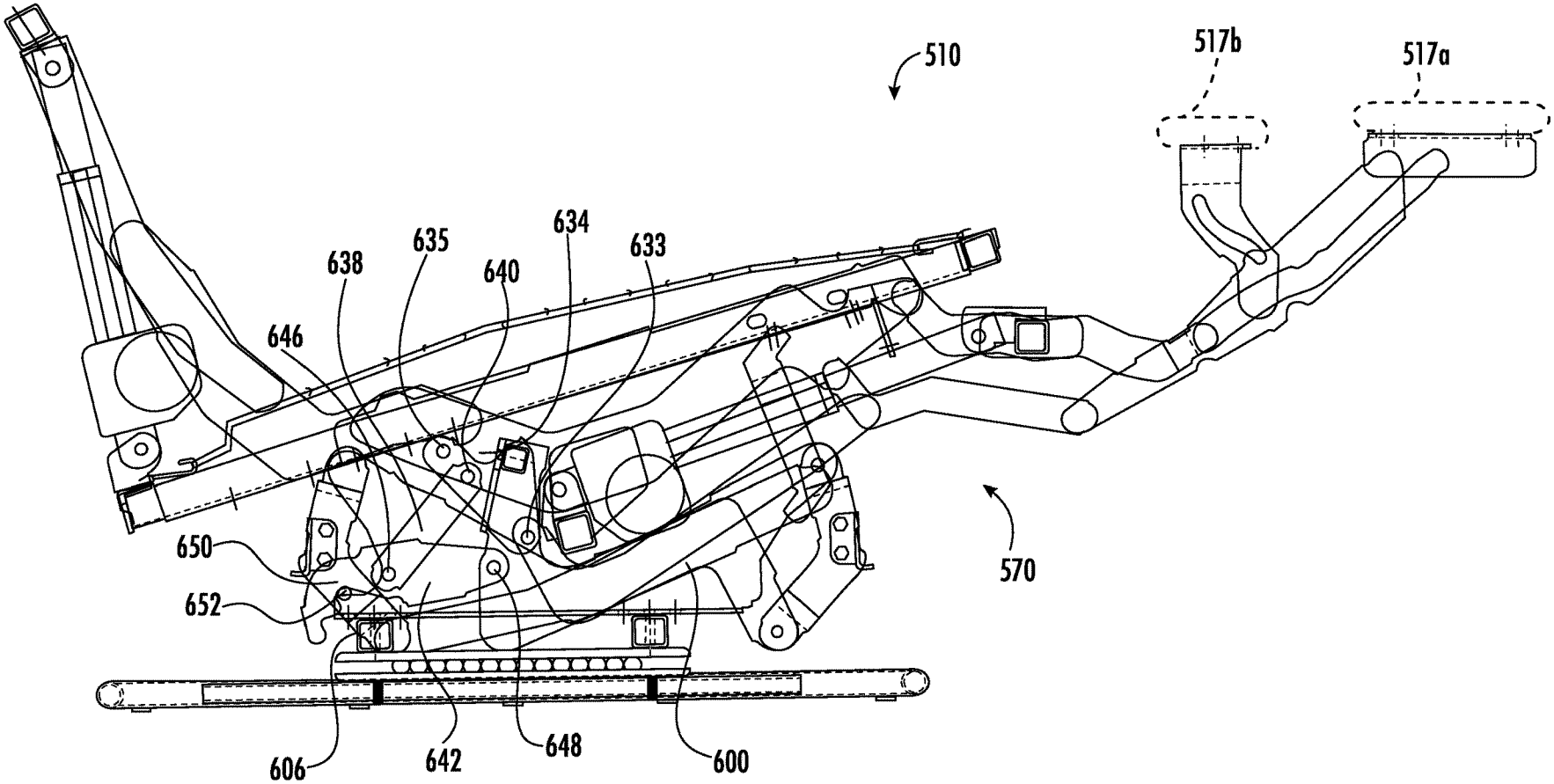
FIG. 13 is a side view of the seating unit of FIG. 11, with the backrest shown in an upright position and the footrests shown in an extended position.
Figure 14:
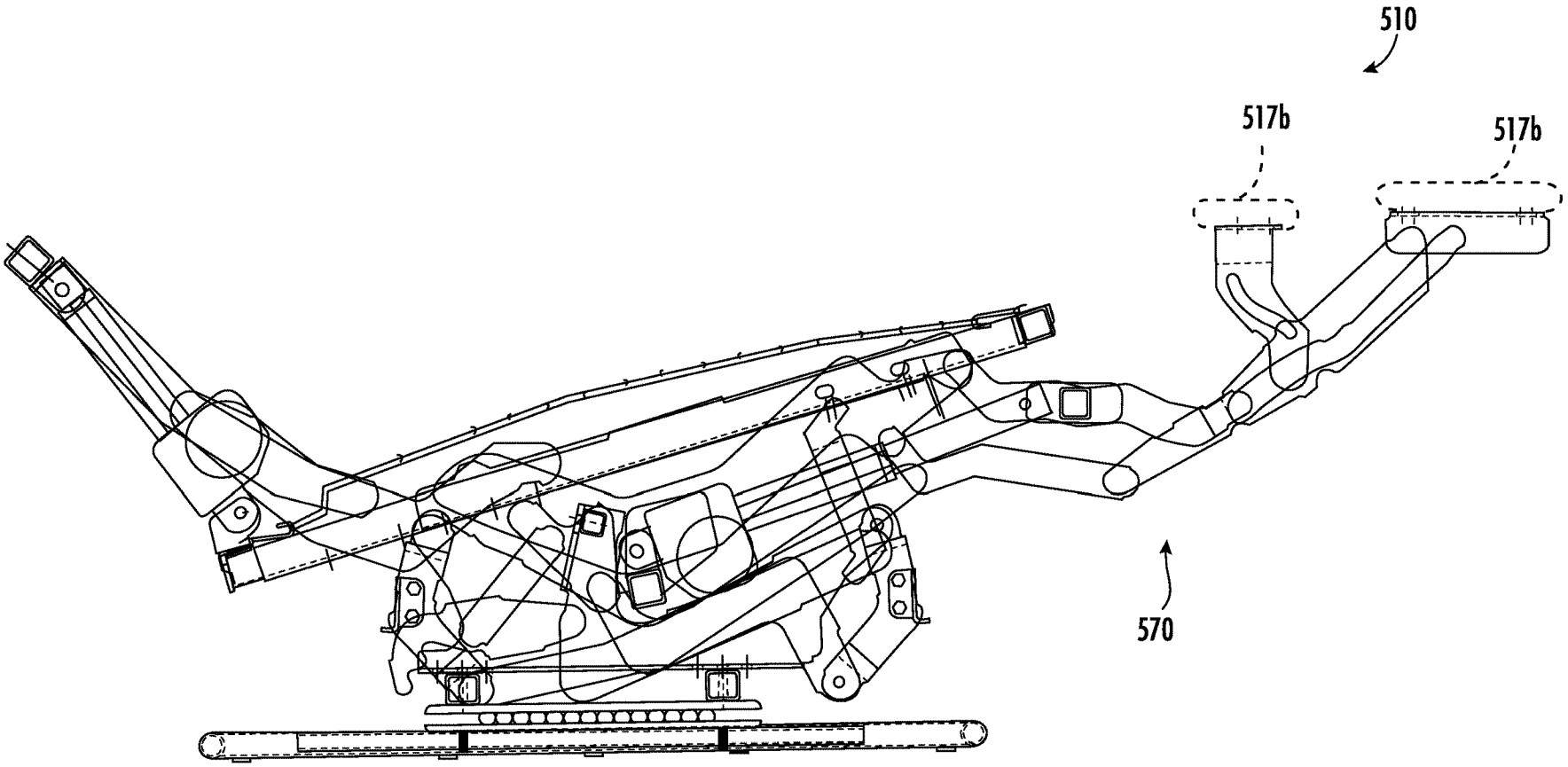
FIG. 14 is a side view of the seating unit of FIG. 11, with the backrest shown in a reclined position and the footrests shown in an extended position.
Figure 15:
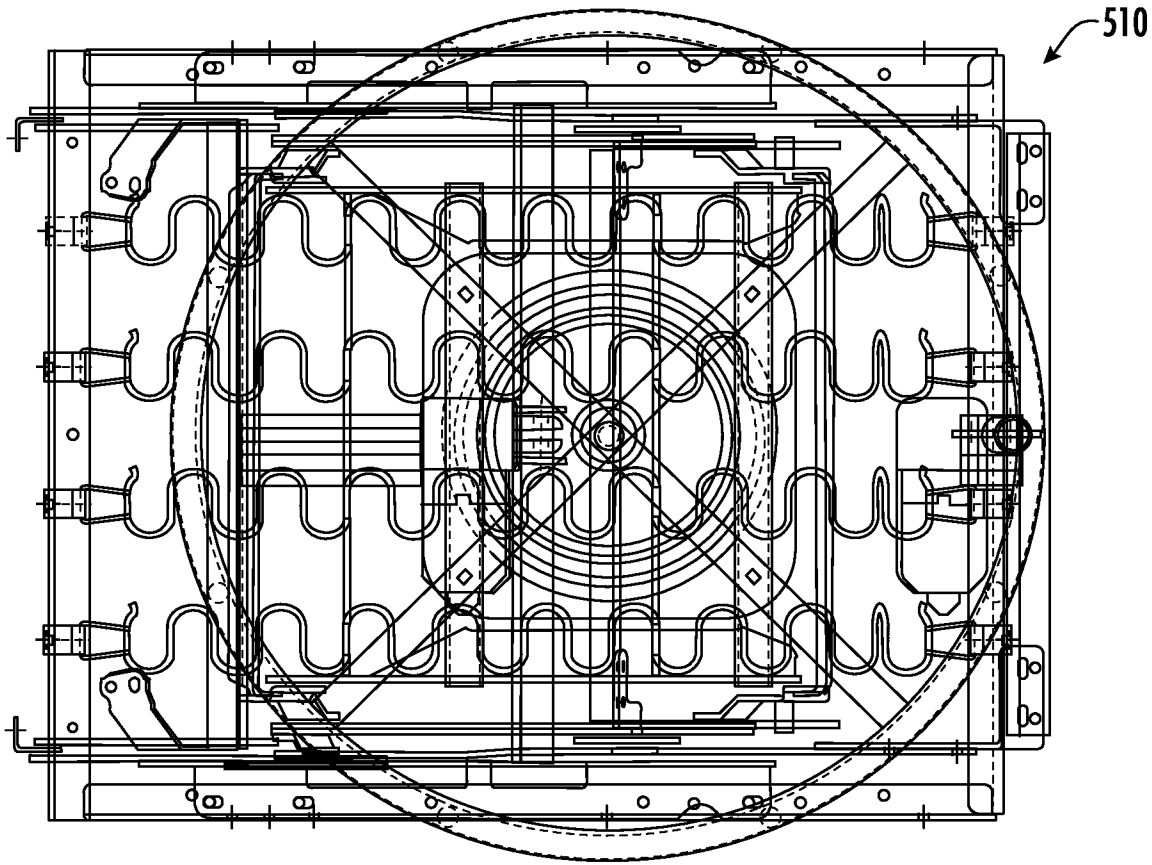
FIG. 15 is a top view of the seating unit of FIG. 11, with the backrest shown in an upright position and the footrests shown in a retracted position.
Figure 16:
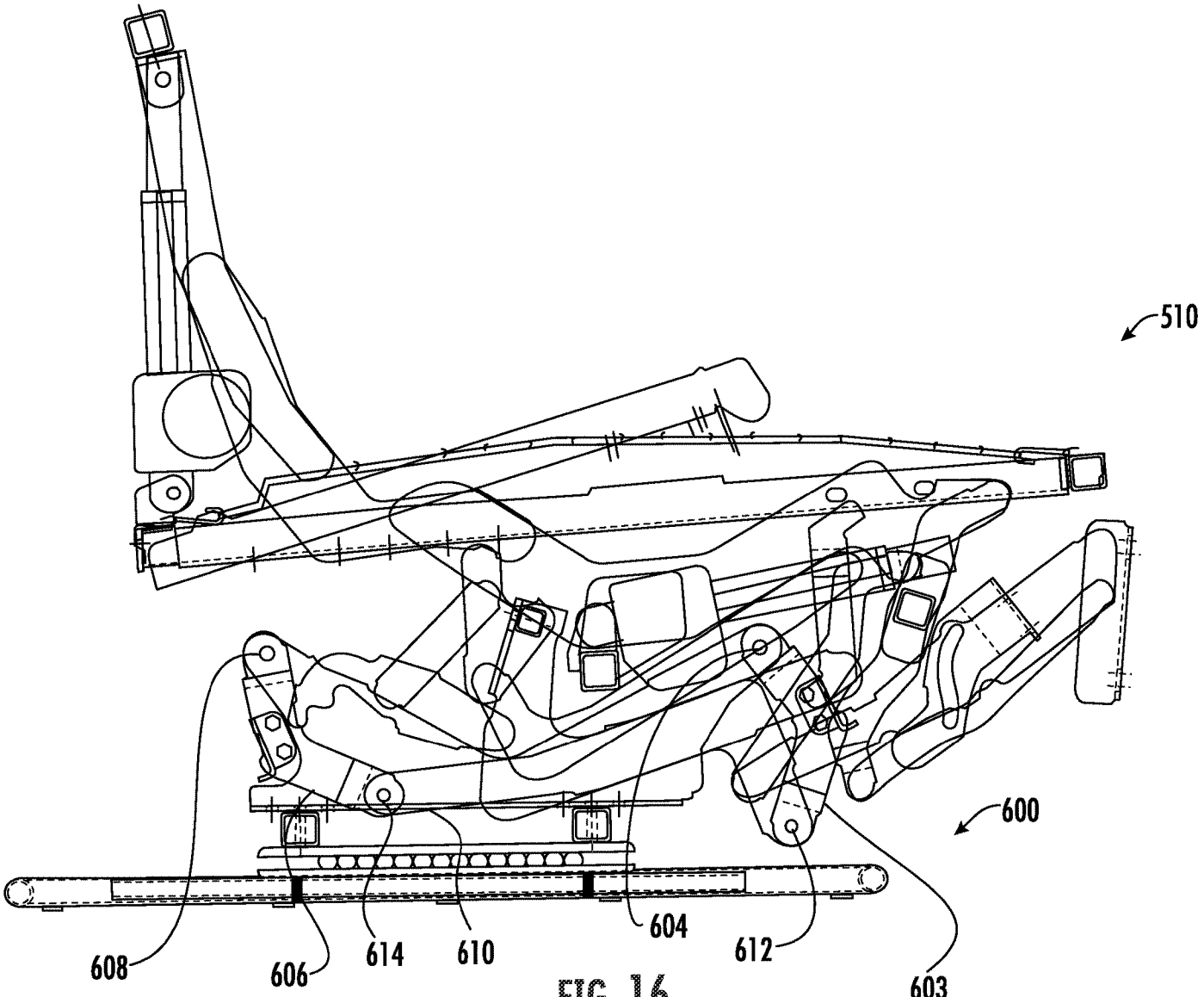
FIGS. 16-19 are side views of the seating unit of FIG. 11, showing the seating unit gliding forward and rearward with the backrest upright (FIGS. 16 and 17) and extended (FIGS. 18 and 19).
Figure 17:
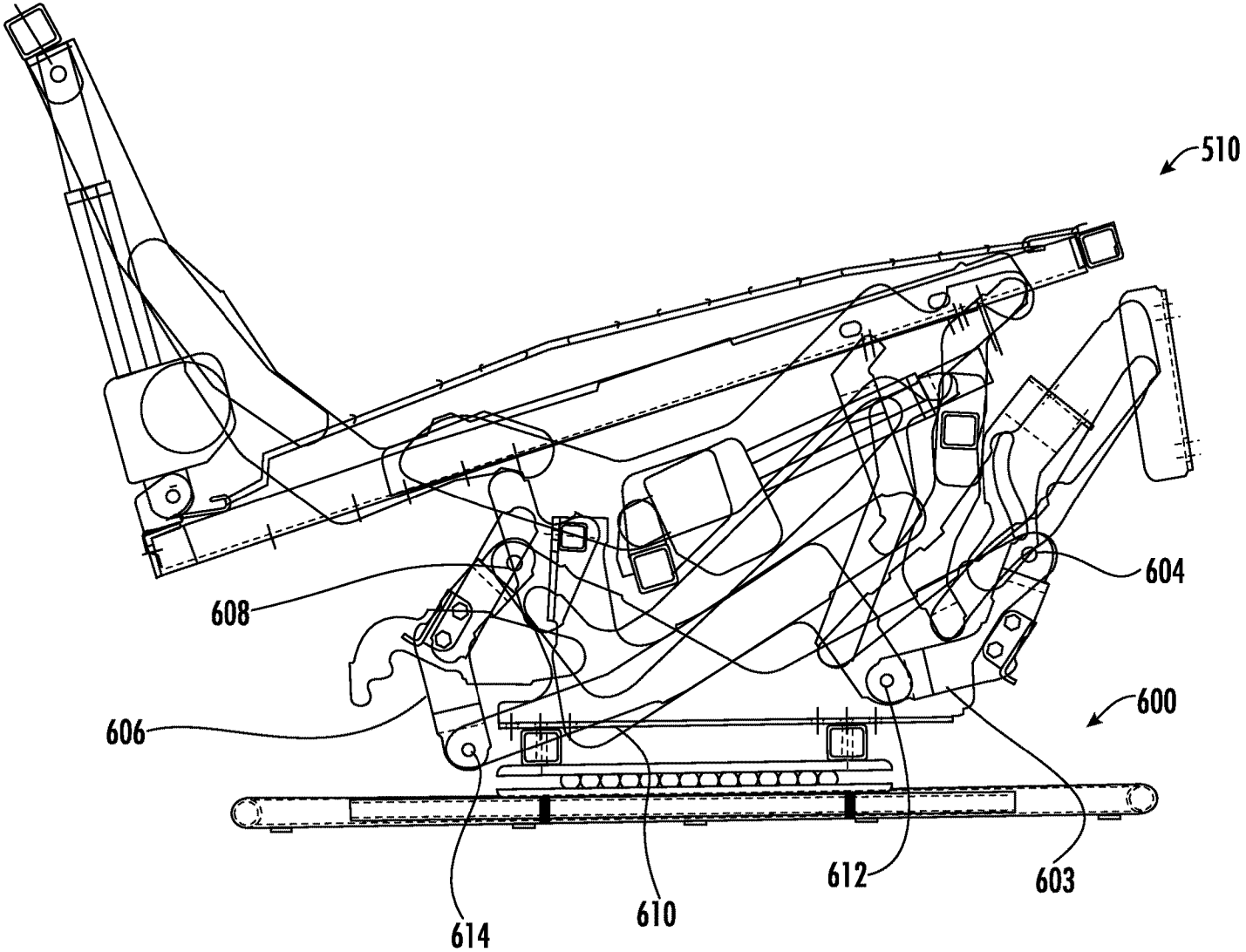
Figure 18:
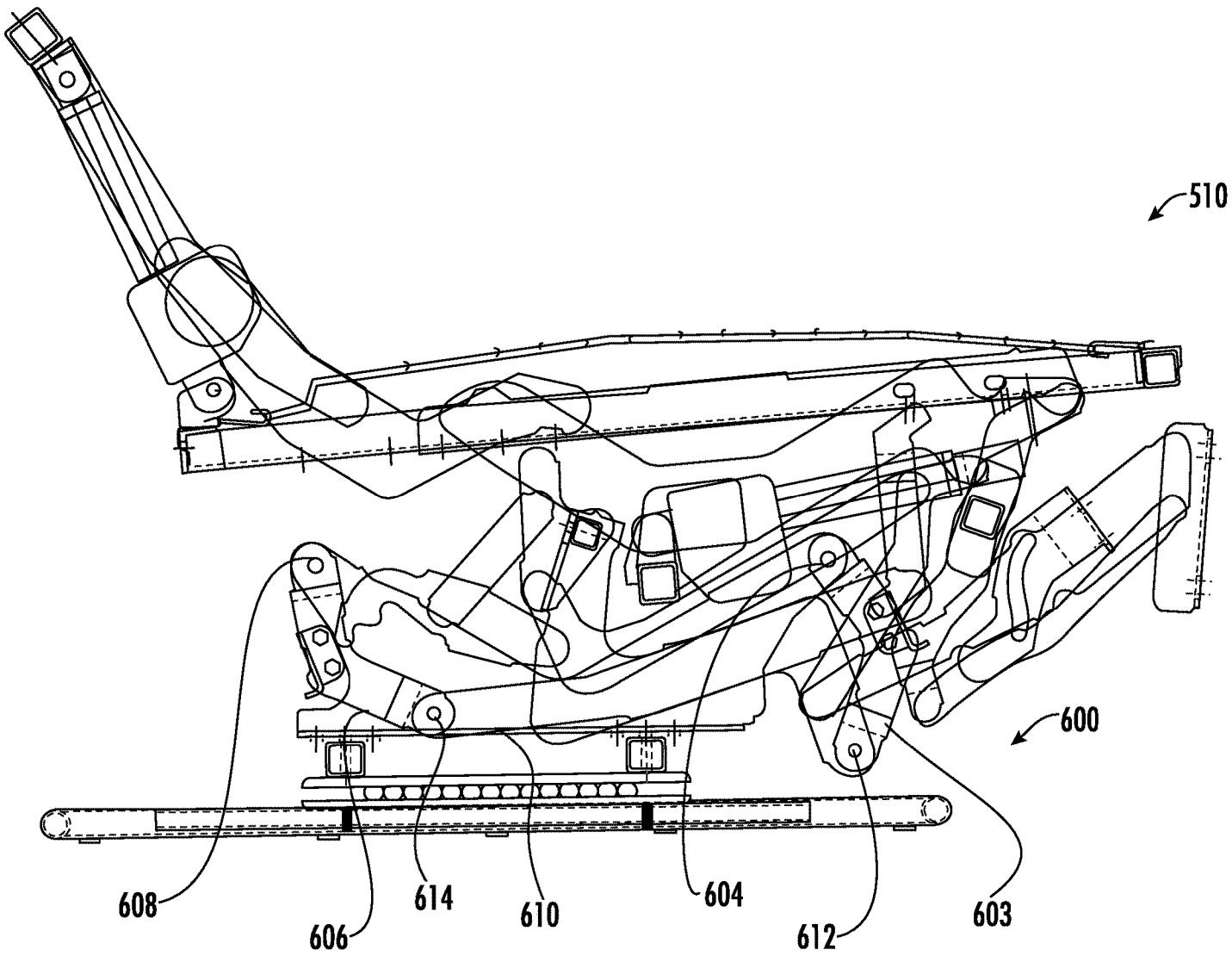
Figure 19:
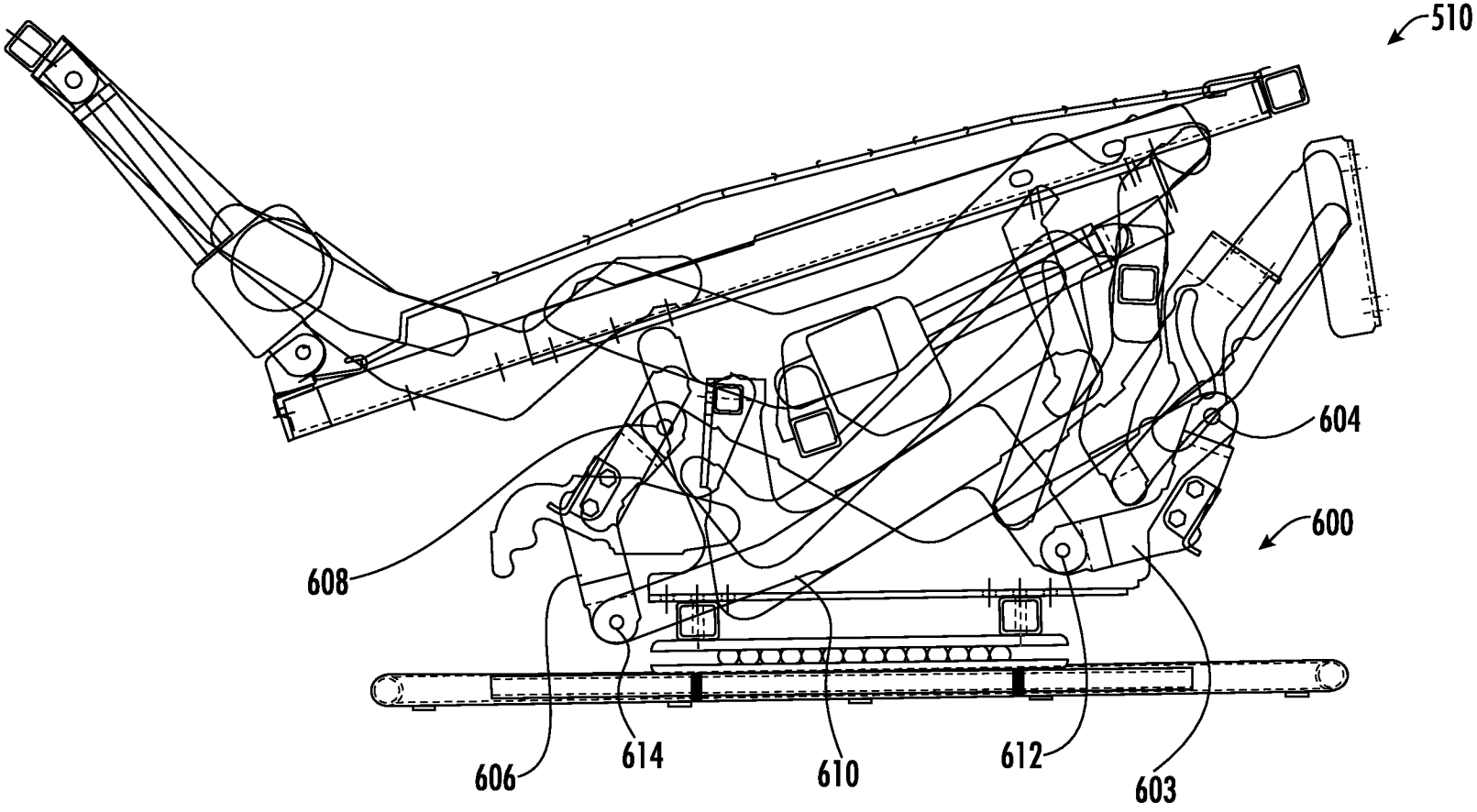

Referring first to FIG. 11, the gliding unit 600 rests atop a swivel unit 580 that enable the remainder of the seating unit 510 to rotate about a vertical axis relative to the base 511. Two cross-members 581 are fixed to an upper plate 582 of the swivel unit 580. A mounting plate 601 is fixed to and extends upwardly from the cross-members 581. A front glide link 603 is mounted at its upper end to the forward end of the mounting plate 601 at a pivot 604. Similarly, a rear glide link 606 is mounted at its upper end to the rear end of the mounting plate 601 at a pivot 608. A tying link 610 is mounted to the lower ends of the front and rear glide links 603, 606 at pivots 612, 614, respectively. The tying link 610 is fixed to a mounting bracket 532.

The reclining mechanism 540 is mounted to the mounting bracket 532 and, with the exception of the locking mechanism 632 described below, is similar to the reclining mechanism 340 described above, including having a linear actuator 554 that is mounted to the rear end of the frame of the seat 513. The footrest mechanism 570 is attached to the seat adapter 566 in the manner discussed above in connection with the footrest mechanism 70. Both the reclining mechanism 540 and the footrest mechanism 570 operate as described above in connection with their respective similar mechanisms.

As noted above, the reclining mechanism 540 includes a locking mechanism 632, which is designed to prevent the seating unit 510 from gliding when the footrests 517*a*, 517*b* are extended. The locking mechanism 632 includes a V-shaped swing link 634, which is attached at its vertex to the rear end of the connecting link 600 at a pivot 633. At the end of its forward leg, the V-shaped swing link 634 is attached to the bracket 532 at a pivot 636, and at the end of its rearward leg, the V-shaped link 634 is attached to the seat adapter 566 at a pivot 635. A drive link 638 is attached at its front end at a pivot 640 to a rear leg of the V-shaped link 634 and extends rearwardly and downwardly therefrom. A locking link 642 is attached at a pivot 646 to the rear end of the drive link 638. The locking link 642 is also attached at its front end to the rear end of the mounting bracket 532 at a pivot 648. The locking link 642 has a pocket 650 near its rear end. The rear glide link 606 has a post 652 near its lower end.

When the footrests 517*a*, 517*b* are retracted, the locking link 642 is in a raised position, such that it does not engage the post 652 on the rear glide link 606. In this position, the rear glide link 606 is free to rotate about the pivot 608, and thus the front glide link 603 is free to rotate about the pivot 604. The freedom of rotation of the front and rear glide links 603, 606 enables the seat 513, the backrest 515, and the footrests 517*a*, 517 to move in a gliding motion forwardly and rearwardly relative to the base 601. Notably, this gliding motion is possible whether the backrest 515 is upright (see FIGS. 16 and 17) or reclined (see FIGS. 18 and 19).

When the footrest mechanism 570 extends the footrests 517*a*, 517*b* as described above in connection with the footrest mechanism 70, the coupling link 600 moves forwardly. This movement rotates the V-shaped link 634 counterclockwise about the pivot 635. This movement forces the drive link 638 downwardly, which in turn causes the locking link 642 to pivot counterclockwise about the pivot 648. This rotation allows the locking link 642 to capture the post 652 of the rear glide link 606 in the pocket 650, which prevents movement of the rear glide link 606 and thereby prevents gliding movement of the seat 513, the backrest 515 and the footrests 517*a*, 517*b* relative to the base 601.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A reclining seating unit, comprising:

a base;

a seat having a seat frame;

a rocking unit configured to allow the seat to reciprocate relative to the base;

a backrest mounted and pivotally interconnected to the seat frame;

a footrest unit;

a reclining mechanism attached to the seat and the backrest, the reclining mechanism configured to control relative movement of the seat and backrest between upright and reclined positions;

a footrest mechanism attached to the seat and the footrest unit, the footrest mechanism configured to control relative movement of the footrest unit and the seat between retracted and extended positions, the footrest mechanism being decoupled from the reclining mechanism;

a first linear actuator attached to the reclining mechanism and to the seat configured to move the seat and backrest between the upright and reclined positions; and a second linear actuator attached to the footrest mechanism and to the seat frame configured to move the footrest unit between the retracted and extended positions;

wherein the reclining seating unit further comprises a locking mechanism coupled to the footrest mechanism, the locking mechanism configured to prevent rocking of the seat relative to the base when the footrest unit is in the extended position.

2. The seating unit defined in claim 1, wherein the second linear actuator extends to move the footrest unit to the extended position, and the first linear actuator retracts to move the backrest to the reclined position.

3. The seating unit defined in claim 1, wherein the first linear actuator and the second linear actuator are pivotally mounted to a common link.

4. The seating unit defined in claim 3, wherein each of the first and second linear actuators includes a motor, and wherein each of the motors is mounted beneath the seat.

5. The seating unit defined in claim 3, wherein the common link moves rearwardly relative to the base as the footrest unit moves to the extended position.

6. The seating unit defined in claim 1, wherein the locking mechanism comprises a connecting link pivotally attached to the footrest mechanism, a drive link pivotally attached to the connecting link, and a locking link pivotally attached to the drive link, wherein in the extended position, the locking link engages the base to prevent rocking movement of the seat relative to the base.

7. The seating unit defined in claim 6, further comprising a stop link fixed to the base, and wherein in the extended position the locking link engages the stop link.

8. The seating unit defined in claim 1, further comprising a controller operatively connected with the first linear actuator and the second linear actuator, the controller configured to prevent the first linear actuator from moving the backrest and seat from the upright position toward the reclined position until the second linear actuator has moved the footrest unit from the retracted position at least a predetermined distance toward the extended position.

9. The seating unit defined in claim 8, wherein the controller is configured such that the predetermined distance is associated with the footrest unit being fully extended.

10. The seating unit defined in claim 9, further comprising a single actuation device operatively connected to the controller.

11. The seating unit defined in claim 10, wherein the actuation device is configured so that an occupant can move the seating unit from the upright position to the fully reclined position with a single manipulable feature.

12. A reclining seating unit, comprising:

a base;

a seat having a seat frame;

a gliding unit configured to allow the seat to move reciprocally relative to the base;

a backrest mounted and pivotally interconnected to the seat frame;

a footrest unit;

a reclining mechanism attached to the seat and the backrest, the reclining mechanism configured to control relative movement of the seat and backrest between upright and reclined positions;

a footrest mechanism attached to the seat and the footrest unit, the footrest mechanism configured to control relative movement of the footrest unit and the seat between retracted and extended positions, the footrest mechanism being decoupled from the reclining mechanism;

a first linear actuator attached to the reclining mechanism and to the seat configured to move the seat and backrest between the upright and reclined positions; and a second linear actuator attached to the footrest mechanism and to the seat frame configured to move the footrest unit between the retracted and extended positions.

13. The reclining seating unit defined in claim 12, wherein the first linear actuator is attached to a rear end of the seat.

14. The reclining seating unit defined in claim 12, wherein the first linear actuator and the second linear actuator are pivotally mounted to a common link.

15. The reclining seating unit defined in claim 12, further comprising a locking mechanism coupled to the footrest mechanism, the locking mechanism configured to prevent reciprocating of the seat relative to the base when the footrest unit is in the extended position.

16. The reclining seating unit defined in claim 12, further comprising a controller operatively connected with the first linear actuator and the second linear actuator, the controller configured to prevent the first linear actuator from moving the backrest and seat from the upright position toward the reclined position until the second linear actuator has moved the footrest unit from the retracted position at least a predetermined distance toward the extended position.

17. The reclining seating unit defined in claim 16, wherein the controller is configured such that the predetermined distance is associated with the footrest unit being fully extended.

18. The reclining seating unit defined in claim 17, further comprising a single actuation device operatively connected to the controller.

19. A reclining seating unit, comprising:

a base;

a seat having a seat frame;

a reciprocating unit configured to allow the seat to reciprocate relative to the base;

a backrest mounted and pivotally interconnected to the seat frame;

a footrest unit;

a reclining mechanism attached to the seat and the backrest, the reclining mechanism configured to control relative movement of the seat and backrest between upright and reclined positions;

a footrest mechanism attached to the seat and the footrest unit, the footrest mechanism configured to control relative movement of the footrest unit and the seat between retracted and extended positions, the footrest mechanism being decoupled from the reclining mechanism;

a first linear actuator attached to the reclining mechanism and to the seat configured to move the seat and backrest between the upright and reclined positions; and a second linear actuator attached to the footrest mechanism and to the seat frame configured to move the footrest unit between the retracted and extended positions;

wherein the first linear actuator and the second linear actuator are pivotally mounted to a common link.

* * * * *